United States Patent [19]

Hawley

[11] Patent Number: 5,018,415

[45] Date of Patent: May 28, 1991

[54] DOOR SECURITY LATCH OPENER AND METHOD OF USING SAME

[75] Inventor: Steven E. Hawley, Denver, Colo.

[73] Assignee: Donita A. Hawley, Denver, Colo.

[21] Appl. No.: 494,132

[22] Filed: Mar. 15, 1990

[51] Int. Cl.[5] ..... E05G 19/20

[52] U.S. Cl. ..... 81/15.9; 81/488

[58] Field of Search ..... 81/15.9, 488; 29/270, 29/278, 426, 427

[56] References Cited

U.S. PATENT DOCUMENTS 4,048,873 9/1977 Stevens ..... 81/15.9
4,561,271 12/1985 Scharboneau ..... 81/488 X
4,785,530 11/1988 Tomlinson ..... 81/488 X
4,882,954 11/1989 Selby ..... 81/15.9

*Primary Examiner*—James G. Smith

[57] ABSTRACT

An unlatching device for disengaging door security latches, of the type with a swing arm and a stationary arm, from the exterior. The security latch opener comprises a thin piece of metal; two finger like prongs formed at one end of the piece of metal; a series of four bends creating an offset area approximately at the center of the piece of metal; said prongs having notches at an outer end for engaging said swing arm of said security latch.

1 Claim, 2 Drawing Sheets

DOOR SECURITY LATCH OPENER AND METHOD OF USING SAME

TECHNICAL FIELD

The security latch opener is a tool that unlatches door security latches from the exterior side of the door. This particular invention comprises a thin piece of rectangular metal; two finger like prongs formed at one end of the piece of metal; a series of four bends creating an offset area approximately at the center of the piece of metal; said prongs having notches at the outer end.

BACKGROUND ART

Occasionally, there are justified reasons for opening a door security latch from the exterior. For example, in a hotel, it is sometimes necessary to enter a guest room immediately in order to render emergency medical attention to a guest. If the security latch is in use, currently it is necessary to call someone for bolt cutters to cut the latch or to breakdown the door. Calling for bolt cutters or breaking down the door causes substantial damage which would also cause necessary replacement and/or repair costing the hotel substantial expenditures to return the door and/or latch to the normal operating condition. Therefore, a tool is warranted to allow immediate access to guest rooms, especially in emergency situations, without damage to property.

It is an object of this invention to provide for the first time a tool that unlatches security latches allowing immediate entry to rooms without wasting valuable time, especially in emergency situations.

It is a further object of this invention to provide a tool that unlatches security latches without damage to doors or latches.

It is a further object of this invention to provide a tool that is simple to use and that is reusable in opening security latches from the outside.

It is a further object of this invention to provide a cost effective tool to enter guest rooms that have the security latches engaged without substantial costs to replace damaged latches or repair doors/frames.

If is a further object of this invention to provide a tool that is convenient for essential personnel to carry on their key ring.

It is a further object of this invention to provide a tool that would be a major asset in an emergency preparedness program. For example, the immediate rescue of an unconscious guest from a smoke filled room.

Further objects and advantages are to provide a security latch opener which can be used easily and conveniently to gain immediate access to a guest room that saves time and time is a precious commodity in an emergency situation, and the security latch opener does not cause damage to the security latch or the door and is simple to use.

DESCLOSURE OF THE INVENTION

In accordance with the above objects and advantages and those that will be mentioned and will become apparent by this invention which provides an unlatching device for unlatching door security latches. This invention comprises: a thin piece of rectangular metal; two finger-like prongs formed at one end of the piece of metal; a series of four bends creating an offset area approximately at the center of the piece of metal; said prongs having notches at an outer end for engaging said swing arm of said security latch.

It is an advantage of this invention to provide more versatile tool which becomes possible by modifying the width of the finger like prongs which will be appropriate for opening a variety of security latches.

BRIEF DESCRIPTION OF DRAWINGS

FIG. 3 is a fragmentary perspective view of the tool of

FIG. 1 and FIG. 2 in use.

Drawing Referecnce Numerals

Figure 1:
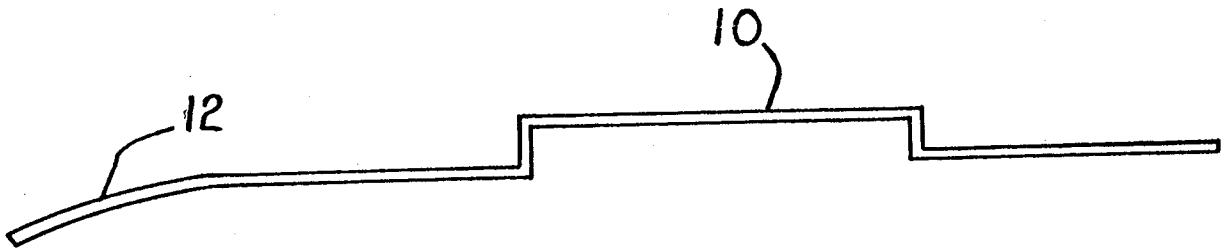
FIG. 1 is a side view of the door security latch opener.

10 Offset
12 Finger like prongs
16 Notches at the end of each finger like prong
18 Hole in body for key ring
20 Tapered swing arm of security latch attached to the door jam
22 Stationary arm of the security latch attached to the door
24 Door stop
26 Door jam
28 Door

BEST MODE FOR CARRYING OUT THE INVENTION

Figure 2:
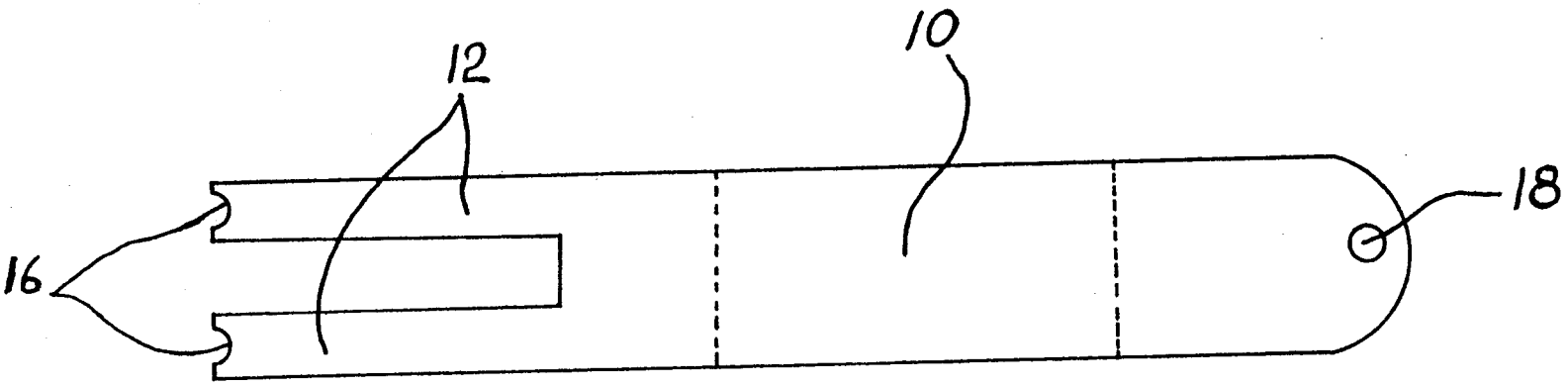
FIG. 2 is a top view of the door security latch opener.
Figure 3:
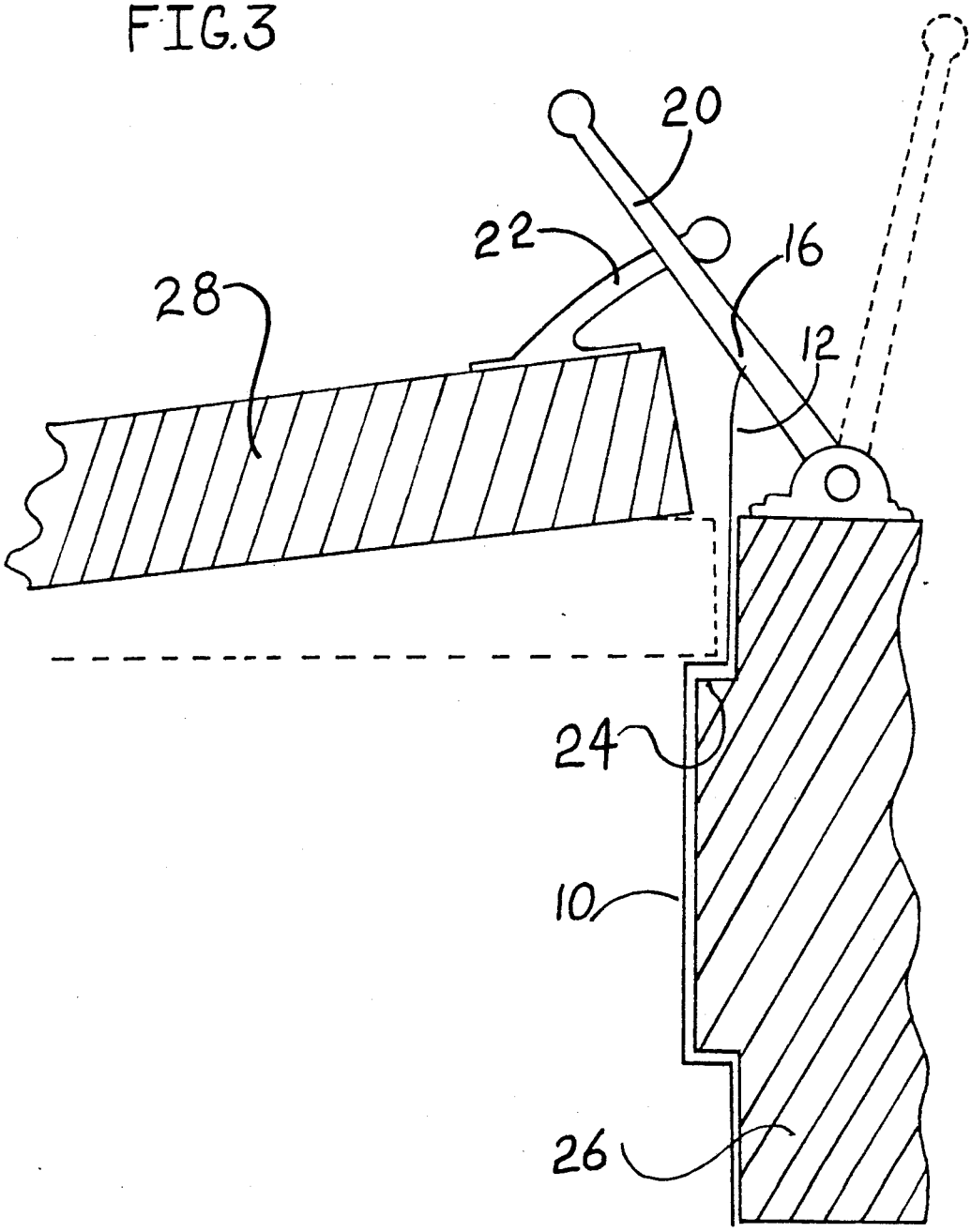

This invention, the door security latch opener (FIG. 1) operates in the following manner:

With the door (28) slightly ajar, the offset (10) of the security latch opener (FIG. 2) is placed horizontally over the door stop (24) with the finger-like prongs (12) extending through the doorway.

Then align and place the notches (16) at the end of the finger-like prongs (12) against the rails of the swing arm (20) portion of the security latch.

Holding the security latch opener securely in place, firmly close the door (28).

As the door (28) is closing, the finger-like prongs (12) of the security latch opener applies pressure to the rails of the swing arm (20) portion of the security latch, allowing the stationary arm (22) of the secruity latch which is attached to the door (28) to track through the tapered opening of the swing arm (20) of the security latch and between the finger like prongs (12). When the stationary arm (22) of the security latch reaches the wide end of the tapered opening of the swing arm (20) of the security latch enabling disengagement, the pressure being applied by the finger-like prongs (12) of the security latch opener disengages the swing arm (20) from the stationary arm (22) of the security latch allowing the door (28) to then be immediately opened.

Accordingly, the reader will see that the security latch opener can be used to disengage a door security latch easily, quickly and safely to insure immediate access to a guest room. The security latch opener will be a major asset in the lodging industry particularly when faced with a guest needing emergency medical attention, and the security latch opener saves time which could save the life of an unconscious guest, allowing immediate entry in cases such as smoke or fire in the room.

Furthermore, the security latch opener has the additional advantages in that:

it provides immediate entry to a guest room;

it enables a property to have a more efficient emergency program;

it is a cost effective tool allowing entry to a room without having to damage the door or the security latch;

it is convenient for essential personnel to keep on a key ring which is easily carried;

it saves time in gaining entry to guest rooms that, in turn, could save lives and property.

Although the description above contains many specificities, these should not be construed as limiting the scope of the invention but as merely providing illustrations of the presently preferred embodiments of the security latch opener. For example, the offset may vary because of the differences in thicknesses of door jams, or the finger-like prongs could vary in length and width to accommodate different types of security latches.

Thus, the scope of the invention should be determined by the appended claims and their legal equivalents, rather than by the examples given.

What is claimed is:

1. A tool for unlatching door security latches, said latches comprising a stationary arm attached to the door and a swing arm attached to a door jam comprising:

a thin piece of rectangular metal; two finger like prongs formed at one end of the piece of metal; a series of four bends creating an offset area approximately at the center of the piece of metal; and prongs having notches at an outer end for engaging said swing arm of said security latch whereby said piece of metal is placed against the door jam with the offset area resting against the door jam and the notches engaging the swing arm; when the door is closed, the notches will apply pressure to the swing arm and cause it to disengage from the stationary arm.

* * * * *